US011761741B2

(12) United States Patent
De Sarran

(10) Patent No.: US 11,761,741 B2
(45) Date of Patent: Sep. 19, 2023

(54) UNDERWATER PROJECTILE, ASSOCIATED ASSEMBLY AND LAUNCH METHOD

(71) Applicant: NAVAL GROUP, Paris (FR)

(72) Inventor: Thibaut De Sarran, Gassin (FR)

(73) Assignee: Naval Group, Paris (FR)

( * ) Notice: Subject to any disclaimer, the term of this patent is extended or adjusted under 35 U.S.C. 154(b) by 59 days.

(21) Appl. No.: 17/627,561

(22) PCT Filed: Jul. 16, 2020

(86) PCT No.: PCT/EP2020/070110

§ 371 (c)(1),
(2) Date: Jan. 14, 2022

(87) PCT Pub. No.: WO2021/009277

PCT Pub. Date: Jan. 21, 2021

(65) Prior Publication Data

US 2022/0260352 A1 Aug. 18, 2022

(30) Foreign Application Priority Data

Jul. 18, 2019 (FR) ..... 19 08105

(51) Int. Cl.
*F42B 19/12* (2006.01)
*F41F 3/10* (2006.01)

(52) U.S. Cl.
CPC ..... *F42B 19/12* (2013.01); *F41F 3/10* (2013.01)

(58) Field of Classification Search
CPC ..... F42B 19/12
See application file for complete search history.

(56) References Cited

U.S. PATENT DOCUMENTS 1,372,295 A * 3/1921 Kasley ..... F42B 19/12 114/20.1
3,301,210 A * 1/1967 Oeland, Jr. ..... F42B 19/12 114/20.1
4,007,505 A * 2/1977 Nowatzki ..... B63G 8/14 367/4

(Continued)

FOREIGN PATENT DOCUMENTS

FR 3002763 A1 9/2014
WO WO 2017/162602 A1 9/2017

OTHER PUBLICATIONS

International Search Report issued in International Application No. PCT/EP2020/070110, dated Sep. 30, 2020.

(Continued)

*Primary Examiner* — J. Woodrow Eldred
(74) *Attorney, Agent, or Firm* — Knobbe, Martens, Olson & Bear, LLP

(57) ABSTRACT

A projectile including: a shell; a rotating shaft; and a screw which can be rotated by the rotating shaft. The screw and the shell include, respectively, a stop and a counter-stop opposite each other. The screw is capable of sliding axially between a first position, in which a non-zero clearance is provided between the stop and counter-stop, and a second position, in which the stop and counter-stop are in contact. An elastic return element reversibly deformable between a first and a second state of stress which correspond to the first and second positions of the screw, respectively, the stress of the first state being lower than the stress of the second state.

15 Claims, 2 Drawing Sheets

(56) References Cited

U.S. PATENT DOCUMENTS

| | | | |
|---|---|---|---|
| 4,690,085 | A | 9/1987 | Dobbs |
| 6,788,145 | B2 | 9/2004 | Tegeler et al. |
| 7,388,145 | B1 | 6/2008 | Olson et al. |

OTHER PUBLICATIONS

Preliminary Search Report issued in FR Application No. 1908105, dated May 18, 2020.

* cited by examiner

UNDERWATER PROJECTILE, ASSOCIATED ASSEMBLY AND LAUNCH METHOD

BACKGROUND

Field

The present invention relates to a projectile, in particular an underwater projectile, of the type including a shell and a propulsion element, said propulsion element comprising: a first rotating shaft able to be set in rotation relative to the shell about an axis; and a first screw able to be driven in rotation by said first rotating shaft.

Description of the Related Art

Conventionally, for safety reasons, underwater projectiles of the torpedo type are launched while their propulsion system is stopped. It is necessary to apply significant thrust to them in order to eject them. It is in particular known to equip launch devices with pneumatic rammers, as described in document WO2017162602.

The ejection force is applied to the rear part of the torpedo and is in particular received by the screw(s). Violent impacts may therefore be transferred to the rotating shafts and/or to the rolling systems bearing said rotating shafts, which can cause damage to the propulsion mechanism.

SUMMARY

The present invention aims to provide a projectile able to minimize the impact of the ejection on the state of the propulsion mechanism.

To this end, the invention relates to a projectile of the aforementioned type, wherein: the first screw and the shell respectively comprise a first stop and a first counter-stop opposite one another; the first screw is able to slide axially along the first rotating shaft between a first position, in which a first non-zero clearance is provided between the first stop and counter-stop, and a second position, in which the first stop and counter-stop are in contact; the propulsion element further includes a first elastic return element, which is reversibly deformable along the axis between a first and a second state of stress, which first and second states correspond respectively to the first and second positions of the first screw, the stress of the first state being lower than the stress of the second state.

According to other advantageous aspects of the invention, the projectile includes one or several of the following characteristics, considered alone or according to all technically possible combinations:

- the first elastic return element is a compression spring, preferably a lock washer;
- the first screw further includes a second counter-stop, axially opposite the first stop;
- the propulsion element further includes: a second rotating shaft able to be set in rotation relative to the shell about the axis; and a second screw able to be rotated by said second rotating shaft; the second screw comprises a second stop opposite the second counter-stop; the second screw is able to slide axially along the second rotating shaft between a third position, in which a second non-zero clearance is provided between the second stop and counter-stop, and a fourth position, in which the second stop and counter-stop are in contact; the propulsion element further includes a second elastic return element, which is reversibly deformable along the axis between a third and a fourth state of stress respectively corresponding to the third and the fourth positions of the second screw, the stress of the third state being lower than the stress of the fourth state;
- the propulsion element is configured such that, when the second screw is in the fourth position relative to the second rotating shaft, the first screw is in the second position relative to the first rotating shaft;
- the second elastic return element is a compression spring, preferably a lock washer;
- the first and second rotating shafts have opposite directions of rotation;
- the projectile comprises a thrust surface able to transfer an axial force to the first screw;
- the thrust surface is supported by the second screw and axially opposite the second stop.

The invention further relates to a launcher assembly comprising: a projectile as described above; and a launching tube including: an inner chamber able to receive the projectile; and an ejection device, able to exert thrust on the thrust surface of the projectile, so as to eject said projectile from the inner chamber.

The invention further relates to a method for launching a projectile as described above, comprising the following steps: applying an axial force against the thrust surface; transferring said axial force to the first stop, so as to cause the first screw to slide along the first rotating shaft, from the first position to the second position; and the passage of the first elastic return element from the first to the second state of stress; and transferring the axial force from the first screw to the shell, leading to launching of the projectile; releasing the first elastic return element from the second to the first state of stress.

According to one preferred embodiment, the transfer of the axial force to the first stop comprises the sliding of the second screw along the second rotating shaft, from the third position to the fourth position; and the passage of the second elastic return element from the third to the fourth state of stress; and simultaneously with the release of the first elastic return element, the method comprises the release of the second elastic return element from the fourth to the third state of stress.

The invention further relates to an operating method of a projectile as described above, in which: each of the first and second rotating shafts is driven in rotation relative to the shell about the axis; and the first and second screws are respectively in the first and in the third positions.

BRIEF DESCRIPTION OF THE DRAWINGS

The invention will be better understood upon reading the following description, provided solely as a non-limiting example and done in reference to the drawings, in which.

DETAILED DESCRIPTION

Figure 1:
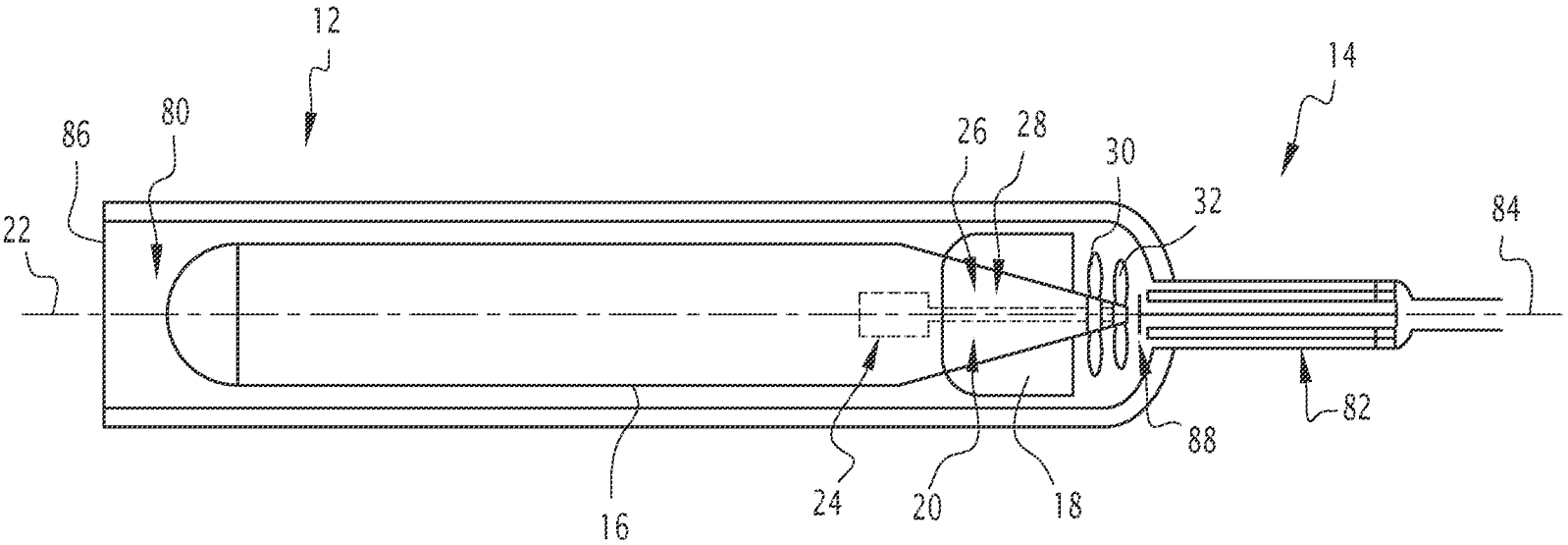
FIG. 1 is a schematic partial sectional view of a launcher assembly comprising a projectile according to one embodiment of the invention.

FIG. 1 shows a launcher assembly 10 according to one embodiment of the invention. The launcher assembly 10 is in particular intended to equip a vessel, such as a surface ship or a submarine.

The launcher assembly 10 is in particular intended to launch a projectile 12 in an underwater environment. The launcher assembly 10 includes the projectile 12 and a launching tube 14.

The projectile 12, for example a torpedo, is able to move in the underwater environment. The projectile 12 in particular includes a shell 16, one or several ailerons 18 and a propulsion element 20.

The shell 16 has a longitudinal shape extending along a movement axis 22. Said main axis 22 constitutes a movement axis of the projectile 12. The propulsion element 20 is able to move the projectile 12 along said main axis 22, in a movement direction. The propulsion element 20 is arranged behind the shell 16 along said movement direction.

The propulsion element 20 comprises: a motor unit 24 arranged inside the shell 16; at least one rotating shaft 26, 28; and at least one screw 30, 32.

The at least one rotating shaft 26, 28 is able to be set in rotation relative to the shell 16, about the main axis 22, by the motor unit 24.

The at least one screw 30, 32 is able to be set in rotation by the at least one rotating shaft 26, 28 about the main axis 22.

As will be outlined hereinafter, the propulsion element 20 further comprises at least one elastic return element 33, 34, associated with the at least one screw 30, 32.

Figure 2:
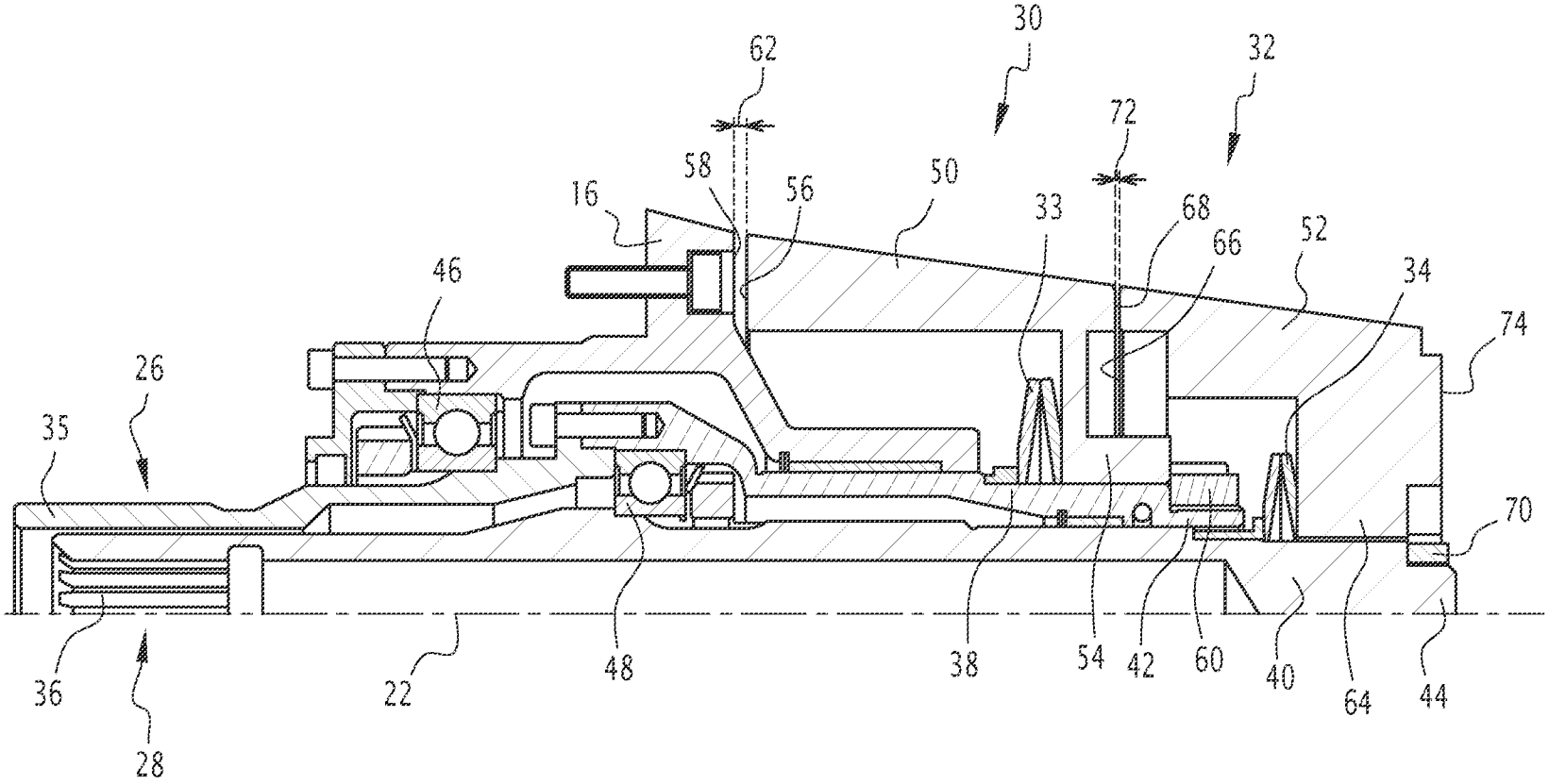
FIG. 2 is a schematic partial sectional view of the projectile of FIG. 1.

A detailed view of the propulsion element 20 is visible in FIG. 2. In the illustrated embodiment, the propulsion element includes a first 26 and a second 28 rotating shaft, which are coaxial and arranged along the main axis 22. For example, the first rotating shaft 26 has a tubular shape, the second rotating shaft 28 being arranged inside said first rotating shaft 26.

A front part 35, 36 of each of the first 26 and second 28 rotating shafts is located inside the shell 16 and connected to the motor unit 24. Preferably, the first 26 and second 28 rotating shafts rotate freely relative to one another. According to one preferred embodiment, the motor unit 24 is able to rotate the first 26 and second 28 rotating shafts in opposite directions of rotation.

Preferably, the motor unit 24 includes two separate motors, each of said motors being connected to one of the rotating shafts 26, 28.

A rear part 38, 40 of each of the first 26 and second 28 rotating shafts forms an axial protrusion outside the shell 16. Furthermore, the rear part 40 of the second rotating shaft 28 forms an axial protrusion relative to the tubular first rotating shaft 26.

Each of the rear parts 38, 40 of the first 26 and second 28 rotating shafts includes a threaded end 42, 44.

First rolling bearings 46 are inserted radially between the shell 16 and the first rotating shaft 26. Likewise, second rolling bearings 48 are inserted radially between the first 26 and the second 28 rotating shafts.

In the embodiment shown in FIGS. 1 and 2, the propulsion element 20 includes a first 30 and a second 32 screw, respectively assembled to the first 26 and the second 28 rotating shaft. As will be outlined hereinafter, each of the first 30 and second 32 screws is able to slide axially on the corresponding rotating shaft 26, 28.

As shown in FIG. 2, the propulsion element 20 includes a first 33 and second 34 elastic return element, which are respectively associated with the first 30 and second 32 screws. As will be outlined hereinafter, each of the first 33 and second 34 elastic return elements is able to deform reversibly along the main axis 22, based on the axial sliding of the associated screw 30, 32 on the corresponding rotating shaft 26, 28. The first 33 and/or the second 34 elastic return element is preferably a compression spring.

Each of the first 30 and second 32 screws respectively includes a first 50 and a second 52 hub, shown in FIG. 2.

The first hub 50 of the first screw 30 includes a first assembly ring 54, in contact with the rear part 38 of the first rotating shaft 26. The first assembly ring 54 is blocked in rotation relative to said rear part 38. The first hub 50 is thus able to be rotated by the first rotating shaft 26.

The first hub 50 further includes a front surface, forming a first stop 56. Said first stop 56 is a surface substantially perpendicular to the main axis 22 and oriented toward the front.

The shell 16 further includes a rear surface, forming a first counter-stop 58. Said first counter-stop 58 is a surface substantially perpendicular to the main axis 22 and oriented toward the rear.

Preferably, each of the first stop 56 and counter-stop 58 is substantially planar and ring-shaped, continuous or fragmented.

In the illustrated embodiment, the first elastic return element is a first lock washer 33, of the Belleville washer type, arranged around the first rear part 38 of the first rotating shaft 26. The front of the first lock washer 33 is blocked axially by said rear part 38; the rear of said first lock washer 33 is in contact with the first mounting ring 54.

The propulsion element 20 includes a first nut 60, associated with the first screw 30. The first nut 60 is mounted on the threaded end 42 of the first rotating shaft 26. The first mounting ring 54 is inserted axially between the first lock washer 33 and the first nut 60.

In a first configuration of the projectile 12, visible in FIG. 2, the first nut 60 is in axial contact with the first mounting ring 54; the first lock washer 33 is compressed axially in a first state of stress, between said first ring 54 and the first rotating shaft 26; furthermore, a first non-zero axial clearance 62 is provided between the first stop 56, borne by the first screw 30, and the first counter-stop 58 borne by the shell 16.

Preferably, the stress of the first lock washer 33 in the first state is non-zero, said first lock washer 33 therefore being pre-stressed in the first configuration of the projectile 12.

The first hub 50 is able to slide on the first rotating shaft 26 between a first position, corresponding to the first configuration described above, and a second position (not shown) in which the first stop 56 and counter-stop 58 are in contact with one another.

When the first hub 50 is in the second position, the first lock washer 33 is axially compressed in a second state of stress, corresponding to a higher stress than the first state. The first lock washer 33 therefore returns the first hub 50 to the first position.

The second hub 52 of the second screw 32 includes a second assembly ring 64, in contact with the rear part 40 of the second rotating shaft 28. The second assembly ring 64 is blocked in rotation relative to said rear part 40. The second hub 52 is thus able to be rotated by the second rotating shaft 28.

The second hub 52 further includes a front surface, forming a second stop 66. Said second stop 66 is a surface substantially perpendicular to the main axis 22 and oriented toward the front.

The first hub 50 further includes a rear surface, forming a second counter-stop 68. Said second counter-stop 68 is a surface substantially perpendicular to the main axis 22 and oriented toward the rear.

Preferably, each of the second stop 66 and counter-stop 68 is substantially planar and ring-shaped, continuous or fragmented.

In the illustrated embodiment, the second elastic return element is a second lock washer 34, of the Belleville washer type, arranged around the first rear part 40 of the second rotating shaft 28. The front of the second lock washer 34 is blocked axially by said rear part 40; the rear of said second lock washer 34 is in contact with the second mounting ring 64.

The propulsion element 20 includes a second nut 70, associated with the second screw 32. The second nut 70 is mounted on the threaded end 44 of the second rotating shaft 28. The second mounting ring 64 is inserted axially between the second lock washer 34 and the second nut 70.

In the first configuration of the projectile 12, visible in FIG. 2, the second nut 70 is in axial contact with the second mounting ring 64; the second lock washer 34 is compressed axially in a third state of stress, between said second ring 64 and the second rotating shaft 28; furthermore, a second non-zero axial clearance 72 is provided between the second stop 66, borne by the second screw 32, and the second counter-stop 68 borne by the first screw 30.

Preferably, the stress of the second lock washer 34 in the third state is non-zero, said second lock washer 34 therefore being pre-stressed in the first configuration of the projectile 12.

The second hub 52 is able to slide on the second rotating shaft 28 between a third position, corresponding to the first configuration of the projectile 12 described above, and a fourth position.

In said fourth position of the second hub 52, the second stop 66 and counter-stop 68 are in contact with one another; and the first stop 56 and counter-stop 58, described above, are also in contact with one another.

More specifically, in the fourth position of the second hub 52 on the second rotating shaft 28, the first hub 50 is compressed axially between the shell 16 and the second hub 52. This fourth position of the second hub 52 corresponds to a second configuration of the projectile 12, not shown.

When the second hub 52 is in the fourth position, the second lock washer 34 is axially compressed in a fourth state of stress, corresponding to a higher stress than the third state. The second lock washer 34 therefore returns the second hub 52 to the third position, corresponding to the first configuration of the projectile 12.

The first 62 and second 72 axial clearances are in particular adjusted during the manufacture of the projectile 12, by the screwing position of the first 60 and second 70 nuts on the corresponding threaded ends 42, 44 of the rotating shafts 26, 28. The stress of each lock washer 33, 34 in the first configuration of the projectile 12 also depends on the screwing position of the corresponding nut 60, 70.

The second hub 52 further includes a rear surface, forming a thrust surface 74 of the projectile 12. Said thrust surface 74 is a surface substantially perpendicular to the main axis 22 and oriented toward the rear.

Preferably, the thrust surface 74 is ring-shaped, continuous or fragmented, arranged at a radial distance from the rotating shafts 26, 28.

According to a variant embodiment that is not shown, the propulsion element of the projectile includes only one rotating shaft 26 and one screw 30. The thrust surface of the projectile is thus formed by the rear surface 68 of the first hub 50, by analogy with FIG. 2.

The launching tube 14 of the launcher assembly 10 will now be described.

The launching tube 14 comprises an inner chamber 80 and a launching device 82. The inner chamber 80, able to contain the projectile 12, has an elongated shape along an axis 84 and includes an opening 86 at one end. The launching device 82, arranged at the other end of the inner chamber 80, is able to eject the projectile 12 from the launching tube through the opening 86.

The launching device 82 for example includes a pneumatic rammer, as described in document WO2017162602. The pneumatic rammer in particular includes a thrust head 88, which is axially movable relative to the inner chamber 80. The thrust head 88 is in particular configured to exert thrust along the axis 84 against the thrust surface 74 of the projectile 12.

In particular, the thrust head 88 is configured to come into axial contact with the thrust surface 74 without coming into contact with the rotating shafts 26, 28. The thrust head 88 for example has a ring-shaped front surface. In a variant that is not shown, the thrust surface 74 forms a rear protrusion relative to the second rotating shaft 28 and the thrust head 88 can then have a disc-shaped front surface.

FIG. 1 shows the launcher assembly 10 in an initial configuration, in which the projectile 12 is received in the inner chamber 80. The main axis 22 of the projectile 12 and the axis 84 of the inner chamber 80 are substantially combined.

A method for implementing the above launcher assembly 10 will now be described.

In an initial state of the method, the launcher assembly 10, for example equipping a submarine, is in a submerged environment. In particular, the launching tube 14 is arranged underwater, the inner chamber 80 is filled with water and the opening 86 for example opens under the surface of the sea. Furthermore, the projectile 12 is received in the launching tube 14, in the initial configuration previously described. The projectile 12 is then in the first configuration, described above and visible in FIG. 2.

The launching device 82 is then activated, leading to the axial movement of the thrust head 88. Said thrust head therefore exerts a force against the thrust surface 74 of the projectile 12, said force being oriented along the main axis 22 and directed in the forward direction.

The thrust force is thus transmitted essentially to the second hub 52, which bears the thrust surface 74 of the projectile 12. The second hub 52 is therefore driven in axial sliding along the second rotating shaft 28, which compresses the second lock washer 34.

From an intermediate position of the second hub 52 along the second rotating shaft 28, the second stop 66 borne by said second hub 52 comes into contact with the second counter-stop 68, borne by the first hub 50. Said first hub 50 is then also driven in axial sliding relative to the first rotating shaft 26, which compresses the first lock washer 33.

The projectile 12 reaches the second configuration, in which the first stop 56 borne by the first hub 50 comes into contact with the first counter-stop 58, borne by the shell 16. The second stop 66 and counter-stop 68 are still in contact with one another.

The axial thrust force exerted by the thrust head 88 is therefore transmitted to the shell 16 of the projectile 12, by means of the second 52 and first 50 hubs. The projectile 12 is thus ejected from the inner chamber 80 through the opening 86.

In particular, the thrust force is transmitted essentially to the shell 16, with a low impact on the rotating shafts 26, 28 and on the rolling bearings 46, 48. The proportion of the thrust force transmitted to the rolling bearings is in particular of the order of 10% to 20%. In fact, the rolling bearings 46, 48 only see the charge of the prestress of the lock washers 33, 34 and the stress exerted by the additional compression of the washers for a travel equal to the functional clearance 62, 72. The risks of deterioration of the propulsion element 20 during the ejection of the projectile 12 are thus minimized.

When the thrust head 88 is no longer in contact with the thrust surface 74, the first 33 and second 34 lock washers relax, returning the projectile 12 to the first configuration. In particular, the first 62 and second 72 axial clearances are reestablished between the shell 16, the first hub 50 and the second hub 52.

When the projectile 12 is outside the launching tube 14, the motor unit 24 of the propulsion element 20 is started. Each of the first 30 and second 32 screws is driven in rotation by the corresponding rotating shaft 26, 28, the first 62 and second 72 axial clearances allowing such rotational movements. The projectile 12 thus moves in an underwater environment.

In particular, during the operation of the motor unit 24, the propulsion force exerted by the screws 30, 32 is much lower than the force exerted by the thrust head 88 in the step for ejecting the projectile 12 from the launching tube. This propulsion force is therefore applied on the lock washers 33, 34 without causing the cancellation of the functional clearances 62, 72.

The axial movement of the first 50 and second 52 hubs being reversible owing to the associated elastic return elements 33, 34, the projectile 12 can be ejected several times according to the above method, without deterioration of the propulsion element 20.

In the variant embodiment mentioned above, according to which the projectile only includes a rotating shaft and a screw, a similar method allows a launcher assembly to be implemented comprising such a projectile associated with the launching tube 14. In particular, the thrust force of the launching tube is transferred to the shell of the projectile by means of the single screw, which is accompanied by the reversible compression of the elastic return element associated with said screw.

What is claimed is:

1. A projectile comprising a shell and a propulsion element, said propulsion element comprising: a first rotating shaft configured to be set in rotation relative to the shell about an axis; and a first screw configured to be driven in rotation by said first rotating shaft;

wherein:

the first screw and the shell respectively comprise a first stop and a first counter-stop opposite one another;

the first screw is configured to slide axially along the first rotating shaft between a first position, in which a first non-zero clearance is provided between the first stop and counter-stop, and a second position, in which the first stop and counter-stop are in contact; and the propulsion element further includes a first elastic return element, which is reversibly deformable along the axis between a first and a second state of stress, which first and second states correspond respectively to the first and second positions of the first screw, the stress of the first state being lower than the stress of the second state.

2. The projectile according to claim 1, wherein the first elastic return element is a compression spring.

3. The projectile according to claim 1, wherein the first screw further includes a second counter-stop, axially opposite the first stop.

4. The projectile according to claim 3, wherein:

the propulsion element further includes: a second rotating shaft to be set in rotation relative to the shell about the axis; and a second screw configured to be rotated by said second rotating shaft;

the second screw comprises a second stop opposite the second counter-stop;

the second screw is configured to slide axially along the second rotating shaft between a third position, in which a second non-zero clearance is provided between the second stop and counter-stop, and a fourth position, in which the second stop and counter-stop are in contact; and the propulsion element further includes a second elastic return element, which is reversibly deformable along the axis between a third and a fourth state of stress respectively corresponding to the third and the fourth positions of the second screw, the stress of the third state being lower than the stress of the fourth state.

5. The projectile according to claim 4, wherein the propulsion element is configured such that, when the second screw is in the fourth position relative to the second rotating shaft, the first screw is in the second position relative to the first rotating shaft.

6. The projectile according to claim 4, wherein the second elastic return element is a compression spring.

7. The projectile according to claim 4, wherein the first and second rotating shafts have opposite directions of rotation.

8. The projectile according to claim 1, comprising a thrust surface configured to transfer an axial force to the first screw.

9. The projectile according to claim 8, wherein:

the propulsion element further includes: a second rotating shaft configured to be set in rotation relative to the shell about the axis; and a second screw configured to be rotated by said second rotating shaft;

the second screw comprises a second stop opposite the second counter-stop;

the second screw is configured to slide axially along the second rotating shaft between a third position, in which a second non-zero clearance is provided between the second stop and counter-stop, and a fourth position, which the second stain and counter-stop are in contact;

the propulsion element further includes a second elastic return element, which is reversibly deformable along the axis between a third and a fourth state of stress respectively corresponding to the third and the fourth positions of the second screw, the stress of the third state being lower than the stress of the fourth state; and the thrust surface is borne by the second screw and axially opposite the second stop.

10. A launching assembly comprising:

a projectile according to claim 8; and a launching tube including: an inner chamber configured to receive the projectile; and an ejection device, configured to exert thrust on a thrust surface of the projectile, so as to eject said projectile from the inner chamber.

11. A method for launching a projectile according to claim 8, comprising:

applying an axial force against the thrust surface;

transferring said axial force to the first stop, so as to cause the first screw to slide along the first rotating shaft, from the first position to the second position; and the passage of the first elastic return element from the first to the second state of stress; then transferring the axial force from the first screw to the shell, leading to launching of the projectile;

releasing the first elastic return element from the second to the first state of stress.

12. The method according to claim 11, for launching a projectile according to claim 9, wherein:

the transfer of the axial force to the first stop comprises the sliding of the second screw along the second rotating shaft, from a third position to a fourth position; and the passage of the second elastic return element from a third to state of stress; and simultaneously with the release of the first elastic return element, the method comprises the release of the second elastic return element from the fourth to the third state of stress.

13. An operating method of a projectile according to claim 4, wherein:

each of the first and second rotating shafts is driven in rotation relative to the shell about the axis; and the first and second screws are respectively in the first and in the third positions.

14. The projectile according to claim 2, wherein the compression spring comprises a lock washer.

15. The projectile according to claim 6, wherein the compression spring comprises a lock washer.

* * * * *